US012766588B2

(12) United States Patent
Prystawsky

(10) Patent No.: US 12,766,588 B2
(45) Date of Patent: Oct. 20, 2026

(54) ADJUSTABLE DOMER DOOR FOR CAN BODYMAKER

(71) Applicant: Stolle Machinery Company, LLC, Centennial, CO (US)

(72) Inventor: Dan S. Prystawsky, Lake in the Hills, IL (US)

(73) Assignee: Stolle Machinery Company, LLC, Centennial, CO (US)

( * ) Notice: Subject to any disclaimer, the term of this patent is extended or adjusted under 35 U.S.C. 154(b) by 303 days.

(21) Appl. No.: 18/601,082

(22) Filed: Mar. 11, 2024

(65) Prior Publication Data

US 2025/0281964 A1 Sep. 11, 2025

(51) Int. Cl.
*B21D 51/26* (2006.01)

(52) U.S. Cl.
CPC ..... *B21D 51/2669* (2013.01)

(58) Field of Classification Search
CPC .... B21D 51/26; B21D 51/2669; B21D 51/30; B21D 22/30
See application file for complete search history.

(56) References Cited

U.S. PATENT DOCUMENTS 6,351,980 B1 * 3/2002 Jowitt ..... B21D 22/30 72/466.8
2020/0047237 A1 * 2/2020 Scholey ..... B21D 51/26

FOREIGN PATENT DOCUMENTS

CN 209272228 U 8/2019
CN 209288099 U 8/2019
JP 2021070035 A 5/2021

OTHER PUBLICATIONS

Commissioner for Patents, ISA/US PCT Appl. No. PCT/US2024/059733, International Search Report, Feb. 27, 2025, 98 pages.

* cited by examiner

*Primary Examiner* — Teresa M Ekiert
(74) *Attorney, Agent, or Firm* — Eckert Seamans Cherin & Mellott, LLC

(57) ABSTRACT

A domer arrangement includes a subframe, for coupling to a frame of a can forming machine, and a domer assembly. The domer assembly includes a domer door having first and second ends. The domer door is adapted to have a domer die coupled thereto. The assembly also includes first and second spacer members, each having first and second faces spaced from each other, the first faces engaged with the subframe and the second faces engaged with the domer door at or about the first and second ends of the domer door. The domer assembly further includes a fastening arrangement rigidly coupling the domer door to the subframe such that the domer door is secured at a predetermined positioning relative to the subframe dependent on the thickness of each of the first and second spacer members.

18 Claims, 6 Drawing Sheets

ADJUSTABLE DOMER DOOR FOR CAN BODYMAKER

FIELD OF THE INVENTION

The disclosed concept relates generally to domer arrangements for use in a can bodymaker, and, more particularly to a domer arrangement having an adjustable domer door. The disclosed concept further relates to can bodymakers including such domer arrangements.

BACKGROUND OF THE INVENTION

Generally, an aluminum can begins as a sheet of aluminum from which a circular blank is cut. The blank is formed into a "cup" having a bottom and a depending sidewall. The cup is fed into a can forming machine, commonly referred to as a "can bodymaker" or simply a "bodymaker", which passes the cup through additional circular dies that thin and elongate the cup. That is, the cup is disposed on a punch mounted on an elongated ram. The ram is structured to reciprocate and pass the cup through the circular dies which (re) draw and iron the cup. That is, on each forward stroke of the ram, a cup is passed through the circular dies which further form the cup into a can body. On the return stroke, the now elongated can body is removed from the ram and a new cup is disposed thereon. Following additional finishing operations, e.g. trimming, washing, printing, etc., the can body is sent to a filler which fills the can with product. A top is then coupled to, and sealed against, the can body, thereby completing the can.

More specifically, the die pack in the bodymaker has multiple, spaced dies, each die having a substantially circular opening. Each die opening is slightly smaller than the next adjacent upstream die. Thus, when the punch draws the cup through the first die, the redraw die, the aluminum cup is deformed over the substantially cylindrical punch. Because the openings in the subsequent dies in the die pack have a smaller inner diameter, i.e., a smaller opening, the aluminum cup is thinned as the ram moves the aluminum through the rest of the die pack. The space between the ram and the redraw die is typically less than about 0.010 inch and less than about 0.004 inch in the last ironing die. After the cup has moved through the last die, the cup bottom and sidewall have the desired thickness; the only other deformation required is to shape the bottom of the cup into an inwardly extending dome.

That is, the distal end of the punch is concave. At the maximum extension of the ram is a "domer." The domer includes a domer door which is rigidly coupled to a frame of the bodymaker and a domer die rigidly coupled thereto that has a generally convex dome and a shaped perimeter. As the ram reaches its maximum extension, the bottom of the can body engages the domer die and is deformed into a dome and the bottom perimeter of the can body is shaped as desired; typically angled inwardly so as to increase the strength of the can body and to allow for the resulting cans to be stacked. As the ram withdraws, the can body is stripped off of the end of the punch by injecting air into the center of the ram. The air comes out of the end of the punch and breaks the can body loose from the punch. Typically, there is also a mechanical stripper, which prevents the can body from staying on the punch as the punch retracts back through the tool pack. The ram is withdrawn through the die pack, a new cup is deposited on the punch, and the cycle repeats.

Currently, every domer door is a unique part dependent on the particular stroke length and domer type being used on a bodymaker. Numerous stroke lengths (e.g., without limitation (in inches), 18.5, 19, 20, 22, 24, 26, 27, 30) are commonly employed. Current domer arrangements take approximately four hours to install and align.

SUMMARY OF THE INVENTION

Embodiments of the disclosed concept address shortcomings in known arrangements by providing solutions that reduce the parts needed in carrying out doming operations, thus reducing cost(s), while also reducing the time needed to install relevant parts. As a first aspect of the disclosed concept, a domer arrangement for use in supporting a domer die in a can bodymaker is provided. The domer arrangement comprises: a subframe structured to be coupled to a frame of the can forming machine; and a domer assembly comprising: a domer door comprising a first end and a second end opposite the first end, the domer door being structured to have the domer die coupled thereto between the first end and the second end; a first spacer member having a first face and a second face opposite and spaced a first thickness from the first face, the first face of the first spacer member engaged with the subframe and the second face of the first spacer member engaged with the domer door at or about the first end of the domer door; a second spacer member having a first face and a second face opposite and spaced a second thickness from the first face, the first face of the second spacer member engaged with the domer door at or about the second end of the domer door and the second face engaged with the subframe; and a fastening arrangement rigidly coupling the domer door to the subframe such that the domer door is secured at a predetermined positioning relative to the subframe dependent on the thickness of each of the first and second spacer members.

The domer arrangement may further comprise a hinge arrangement, wherein the domer door is pivotably and slidably coupled to the subframe at or about the first end thereof via the hinge arrangement. The hinge arrangement may comprise an upper hinge pin and a lower hinge pin axially aligned with, and spaced from the upper hinge pin; the first end of the domer door may comprise an upper cylindrical recess extending downward from a top surface of the domer door and a lower cylindrical recess extending upward from a bottom surface of the domer door axially aligned with the upper cylindrical recess; a lower portion of the upper hinge pin may be positioned within the upper cylindrical recess of the first end of the domer door and an upper portion of the upper hinge pin may be positioned within an elongated slot defined in the subframe; an upper portion of the lower hinge pin may be positioned within the lower cylindrical recess of the first end of the domer door and a lower portion of the lower hinge pin may be positioned within another elongated slot defined in the subframe.

The subframe may comprise a first support arm and a second support arm; the first support arm may include a first end structured to be coupled to the frame of the can forming machine and a second end selectively coupled to the first end of the domer door via a portion of the fastening arrangement; and the second support arm may include a first end structured to be coupled to the frame of the can forming machine and a second end selectively coupled to the second end of the domer door via another portion of the fastening arrangement.

The fastening arrangement may comprise: a first swing bolt having a first end and a second end opposite the first end, the first end being pivotably coupled to the subframe and the second end having a threaded portion extending therefrom toward the first end; a second swing bolt having a first end and a second end opposite the first end, the first end being pivotably coupled to the subframe and the second end having a threaded portion extending therefrom toward the first end; a first threaded nut threadingly engaged with the threaded portion of the first swing bolt; and a second threaded nut threadingly engaged with the threaded portion of the second swing bolt, wherein when the first threaded nut and the second threaded nut are each tightened on the respective threaded portions of the first and second swing bolts, the domer door is secured at the predetermined positioning dependent on the thickness of each of the first and second spacer members. The domer arrangement may further comprise a first pin coupled to the subframe and a second pin coupled to the subframe, wherein: the first swing bolt comprises an aperture defined therein at the first end of the first swing bolt; the second swing bolt comprises an aperture defined therein at the first end of the second swing bolt; the first end of the first swing bolt is pivotably coupled to the subframe via engagement between the first pin and the aperture defined at the first end of the first swing bolt; and the first end of the second swing bolt is pivotably coupled to the subframe via engagement between the second pin and the aperture defined at the first end of the second swing bolt. The domer door may comprise a first notched portion defined in the domer door extending inward from the first end of the domer door; the domer door may comprise a second notched portion defined in the domer door extending inward from the second end of the domer door; the first swing bolt may be positioned in the first notched portion; and the second swing bolt may be positioned in the second notched portion.

The domer arrangement may further comprise the domer die coupled to the domer door. The domer arrangement may further comprise: a third spacer member having a first face and a second face opposite the first face, the first face of the third spacer member being structured to be engaged with the domer door at or about the first end of the domer door and the second face of the third spacer member being structured to be engaged with the subframe; and a fourth spacer member having a first face and a second face opposite the first face, the first face of the fourth spacer member being structured to be engaged with the domer door at or about the second end of the domer door and the second face of the fourth spacer member being structured to be engaged with the subframe, wherein the first face and the second face of the third spacer member are spaced a third distance different than the first distance, wherein the first face and the second face of the fourth spacer member are spaced a fourth distance different than the second distance, wherein the third spacer member is structured to be positioned in place of the first spacer member, and wherein the fourth spacer member is structured to be positioned in place of the second spacer member.

As another aspect of the disclosed concept, a can forming machine is provided. The can forming machine comprises: a frame; an operating mechanism coupled to the frame and structured to reciprocally move a ram body between a first retracted position and a second extended position; a ram body comprising an elongated body with a longitudinal axis and a distal end; a punch disposed at the distal end of the ram body; a die assembly coupled to the frame and having at least one die with an opening therein and a longitudinal axis; the punch positioned to move generally horizontally through the die opening with said ram body longitudinal axis and said die assembly longitudinal axes being substantially aligned; and a domer arrangement such as described above.

As a further aspect of the disclosed concept, a method of adjusting the positioning of a domer die assembly of a can forming machine with respect to a frame of the can forming machine is provided. The method comprises: uncoupling a fastening arrangement coupling a domer door from the frame of the can forming machine, the domer door having the domer die assembly coupled thereto; sliding the domer door away from the frame and pivoting a second end of the domer door away from the frame; inserting a first spacer member between a first end of the domer door and the frame; inserting a second spacer member between the second end of the domer door and the frame; pivoting the second end of the domer door toward the frame and sliding the domer door against the first spacer member and the second spacer member; and coupling the fastening arrangement coupling the domer door to the frame.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
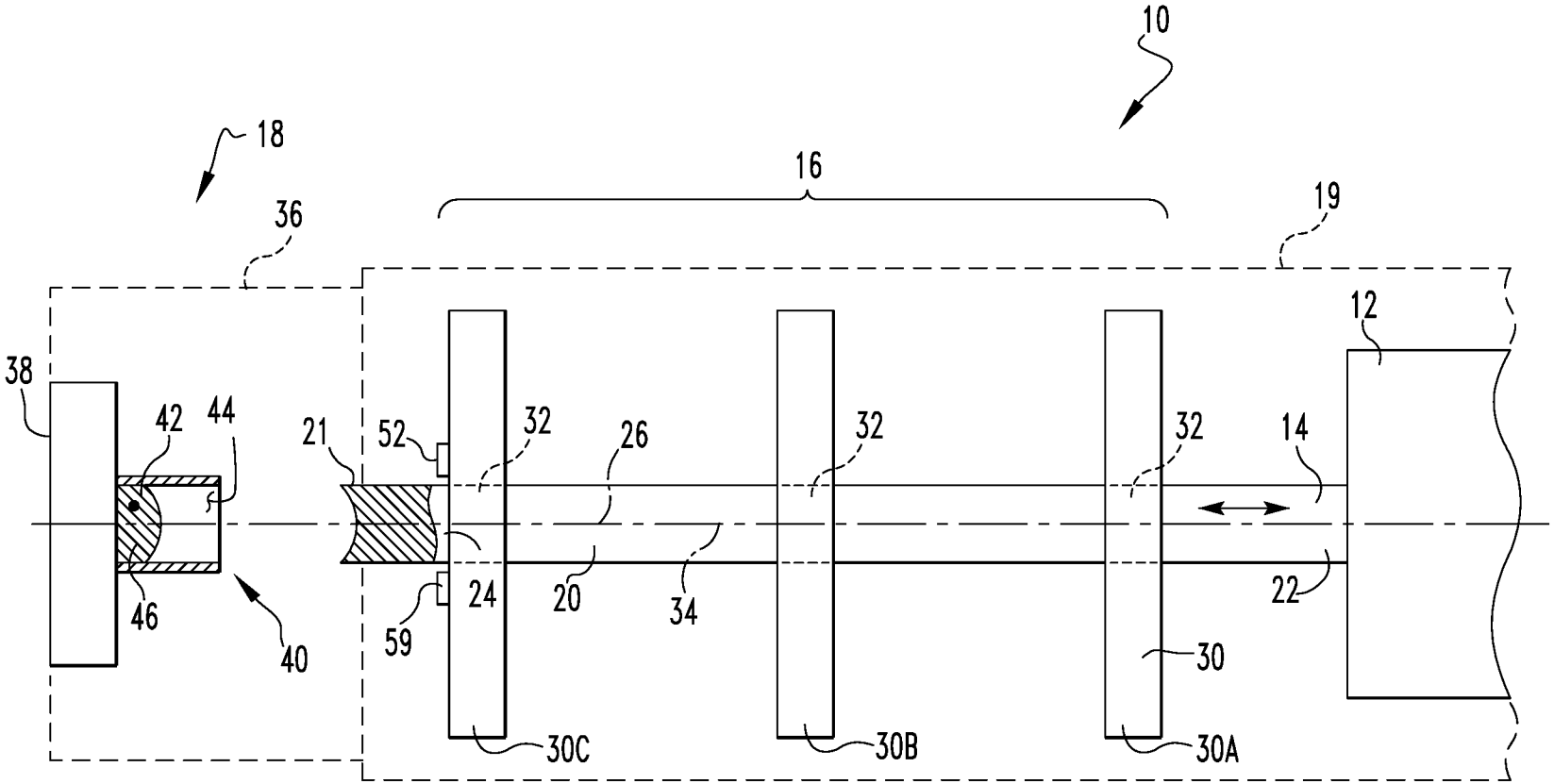
FIG. 1 is a schematic cross-sectional view of a can forming machine in accordance with an example embodiment of the disclosed concept.
Figure 2:
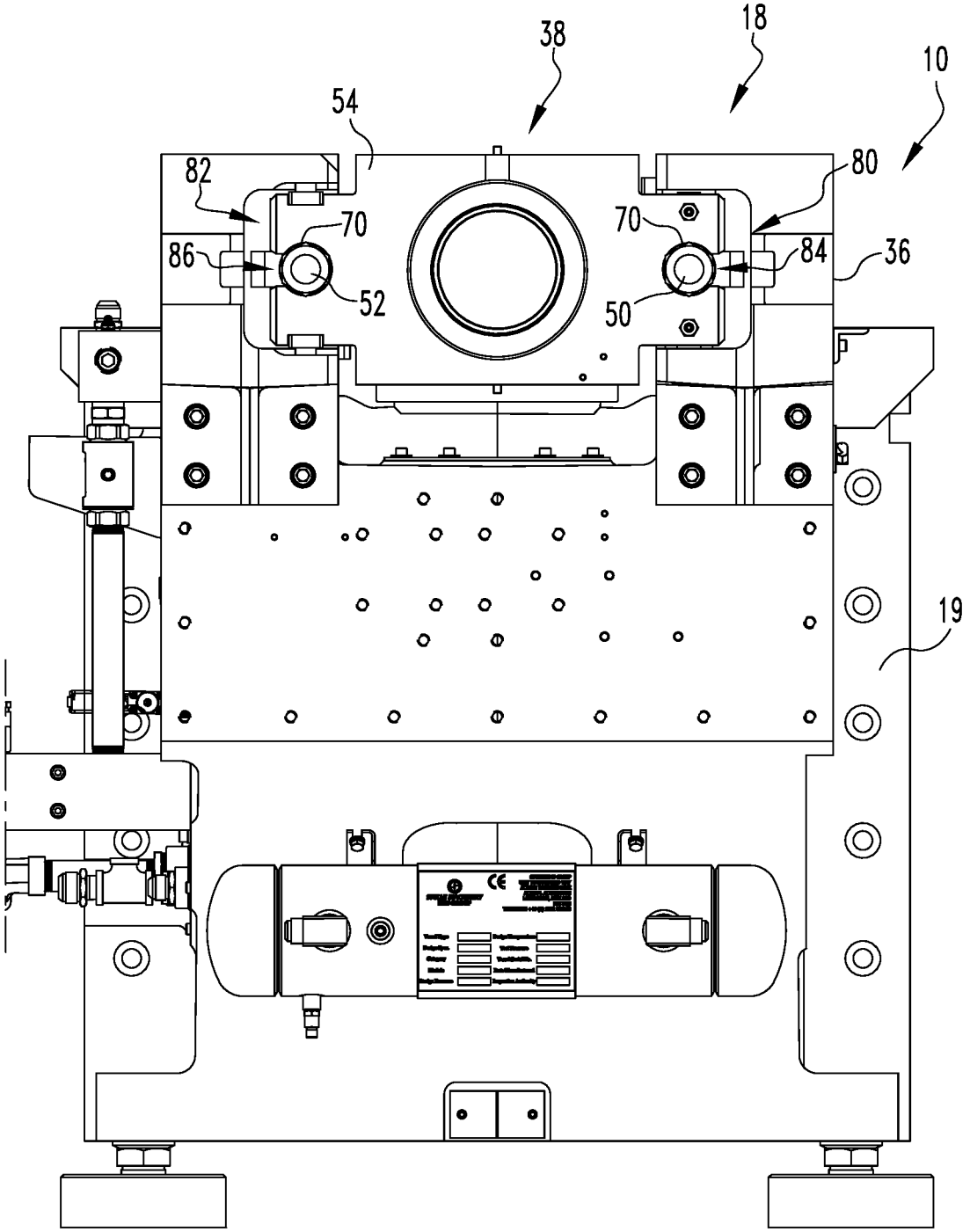
FIG. 2 is an elevation end view of a portion of a can forming machine in accordance with an example embodiment of the disclosed concept.

It will be appreciated that the specific elements illustrated in the figures herein and described in the following specification are simply exemplary embodiments of the disclosed concept, which are provided as non-limiting examples solely for the purpose of illustration. Accordingly, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, the term "number" shall mean one or an integer greater than one (i.e., a plurality). That is, for example, the phrase "a number of elements" means one element or a plurality of elements. It is specifically noted that the term "a 'number' of [X]" includes a single [X].

As used herein, "coupled" means a link between two or more elements, whether direct or indirect, so long as a link occurs. An object resting on another object held in place only by gravity is not "coupled" to the lower object unless the upper object is otherwise maintained substantially in place. That is, for example, a book on a table is not coupled thereto, but a book glued to a table is coupled thereto.

As used herein, "directly coupled" means that two elements are directly in contact with each other.

As used herein, "fixedly coupled" or "fixed" means that two components are coupled so as to move as one while maintaining a constant orientation relative to each other. The fixed components may, or may not, be directly coupled.

As used herein, "pivotably coupled" means that two components are coupled such that each component can pivot/rotate with respect to the other component, but each component is constrained from any other relative motion with respect to the component. For example, a door coupled to a frame via a number of hinges is "pivotably coupled" to the frame, since the door can rotate/pivot with respect to the frame (or vice versa) about the axis of the hinges, but is constrained from any other movement relative to the frame.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled."

As used herein, the word "unitary" means a component is created as a single piece or unit. That is, a component that includes pieces that are created separately and then coupled together as a unit is not a "unitary" component or body.

As used herein, "associated" means that the identified components are related to each other, contact each other, and/or interact with each other. For example, an automobile has four tires and four hubs, each hub is "associated" with a specific tire.

As used herein, the statement that two or more parts or components "engage" one another means that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As shown schematically in FIG. 1, a can forming machine, or can bodymaker 10 includes an operating mechanism 12 structured to provide a cyclical and/or reciprocating motion, a ram 14, a die assembly 16, and a domer arrangement 18, all generally mounted/coupled (directly or indirectly) to a frame 19 via various suitable means. The ram 14 has an elongated, substantially cylindrical elongated body 20 with a proximal end 22, a distal end 24, and a longitudinal axis 26. A punch 21 is disposed at, or over, the distal end 24 of the ram body. The punch 21 is a generally cylindrical body with a concave distal end (not numbered) which may be shaped to correspond to a cavity 44 of a domer die 40, discussed further below. The proximal end 22 of the ram body 20 is coupled to the operating mechanism 12. The operating mechanism 12 provides a reciprocal motion to the ram body 20 causing the ram body 20, and therefore the punch 21, to move back and forth along its longitudinal axis 26. That is, the punch 21 is structured to reciprocate between a retracted position and an extended position, the punch 21 extending and moving generally horizontally through the die assembly 16 during such reciprocal motion.

The die assembly 16 includes at least one (three as shown) die(s) 30 (each) having an opening 32 therein. The opening 32 in the first die 30A (the die 30 closest to the operating mechanism 12) is slightly larger than the opening 32 in the second (middle, as shown) die 30B. The opening 32 in the second die 30B is slightly larger than the opening 32 in the third (farthest from the operating mechanism 12) die 30C. That is, the opening 32 in the first die 30A has a radius that is about 0.010 inch larger than the radius of the punch 21, the opening 32 in the second die 30B has a radius that is about 0.007 inch larger than the radius of the punch 21, and opening 32 in the third die 30C has a radius that is about 0.004 inch larger than the radius of the punch 21. The die assembly openings 32 are disposed along a common axis 34. The die assembly axis 34 is generally aligned with the longitudinal axis 26 of the ram body 20.

In this configuration, the can forming machine 10 is structured to transform a cup into a can body, which may have a top added, forming a can. A cup is disposed over the punch 21, typically when the punch 21 is in the retracted position. When the punch 21 pushes the aluminum disk through the die assembly 16, the cup is thinned and stretched to a desired length and wall thickness. The elongated cup is a can body.

The domer arrangement 18 is disposed at the end of the stroke of the ram body 20. The domer arrangement 18 includes a subframe 36 coupled to the frame 19 of the can forming machine 10 and a domer assembly 38 (discussed in detail below) having a domer die 40. The domer die 40 is a body 42 with a cavity 44 defining a dome 46. The cavity 44 may include other features structured to shape the bottom of the cup after passing through the die assembly 16. The center of the dome 46 is substantially aligned with the longitudinal axis 26 of the ram body 20. In this configuration, when the ram body 20 is at its maximum extension, the cup bottom, i.e., the portion of the cup extending over the end of the punch 21, is shaped by the punch 21 entering the cavity 44 of the body 42 of the domer die 40. That is, the cup bottom becomes an upwardly extending dome. After the dome is formed in the bottom of the can body, the ram body 20 begins the rearward portion of the stroke. A can stripper (not shown) is disposed on the outer surface of the third die 30C. The can stripper removes the can body from the punch 21. Thus, the punch 21 travels rearwardly with no cup or other material between the punch 21 and the dies 30A, 30B, 30C.

In the example embodiment shown in FIGS. 2-6, the domer assembly 38 includes a fastening arrangement including a first swing bolt 50 and a second swing bolt 52, and a domer door 54. The first swing bolt 50 includes a first end 56 (FIG. 5) and a second end 58 opposite the first end 56, with the first end 56 pivotably coupled to the subframe 36. In the example embodiment shown in FIG. 5, the first end 56 of the first swing bolt 50 is pivotably coupled to a first support arm 60 of the subframe 36 and, more particularly, is pivotably coupled at or about a second end (not numbered) of the first support arm 60 that is opposite to a first end (not numbered) that is coupled (e.g., via fasteners or any other suitable arrangement) to the frame 19 of the can forming machine 10. In such example the pivotal coupling is accomplished by the interaction of a pin 62, fixedly coupled (e.g., via a partially threaded interaction) in an aperture 64 defined in the first support arm 60 with an aperture 66 defined in the first swing bolt 50 at or near the first end 56 of the first swing bolt 50. The first swing bolt 50 further includes a threaded portion 68 (shown schematically in cross-section FIG. 5) extending from the second end 58 toward the first end 56. The first threaded portion 68 is structured to receive a first threaded nut 70 selectively threadingly engaged therewith as discussed further below. In such example, the second swing bolt 52 is of similar arrangement and coupling except for being pivotably coupled to a second support arm 72 of the subframe 36 and thus not discussed in further detail herein.

Continuing to refer to FIGS. 2-5, the domer door 54 includes a first end 80 and a second end 82 opposite the first end 80. The domer door 54 is structured to have the domer die 40 (FIGS. 2 and 3) coupled thereto (e.g., via conventional or any suitable coupling arrangement(s)) between the first end 80 and the second end 82. The first end 80 of the domer door 54 has a first portion 84, that when the domer assembly 38 is assembled and positioned for operation of the can forming machine 10, is disposed about the first swing bolt 50 between the first end 56 and the second end 58 of the first swing bolt 50. Meanwhile, the second end 82 of the domer door 54 similarly includes a second portion 86 disposed about the second swing bolt 52 between the first end and the second end of the second swing bolt 52 similar to the interaction between the first portion 84 and the first swing bolt 50. In such example embodiment, the first and second portions 84 and 86 are in the form of notched portions 88 and 90 defined in the domer door 54 extending inward respectively, from the first and second ends 80 and 82 of the domer door 54.

Figure 4:
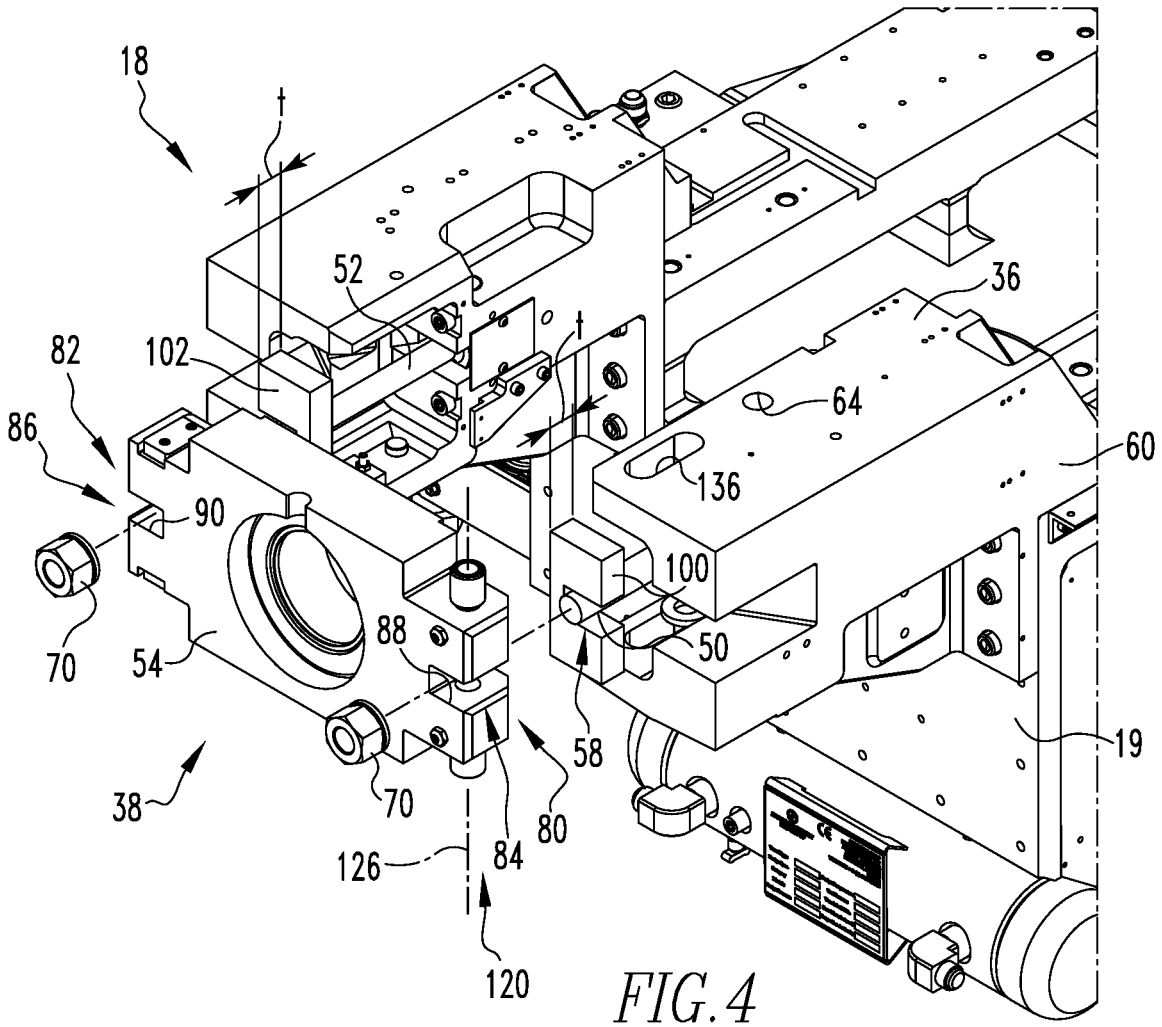
FIG. 4 is a partially schematic isometric view of the portion of the can forming machine of FIGS. 2 and 3 shown with a domer door and related components exploded therefrom.
Figure 5:
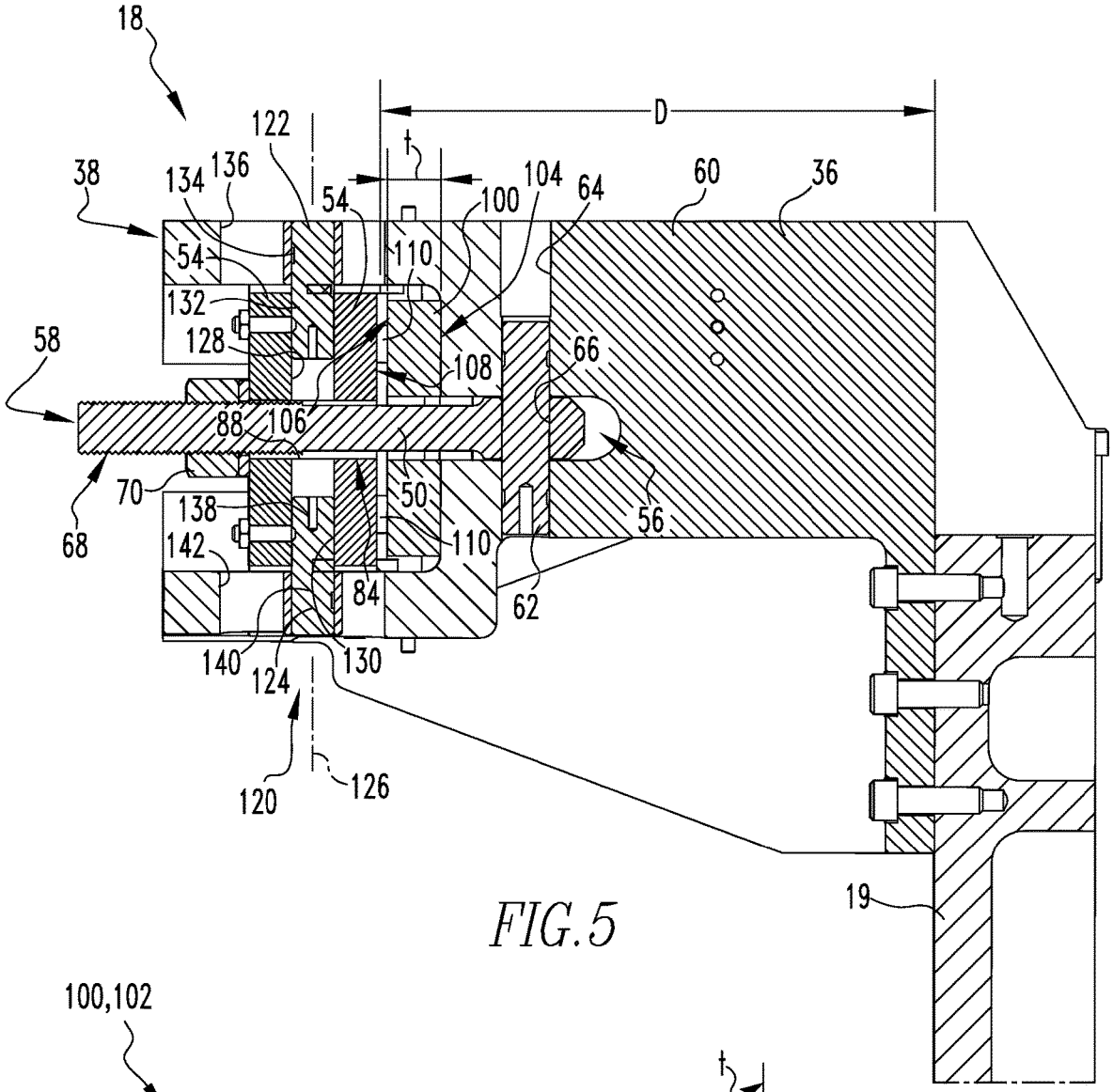
FIG. 5 is a sectional view of the portion of the can forming machine of FIGS. 2-4 taken along 5-5 of FIG. 3.
Figure 6A:
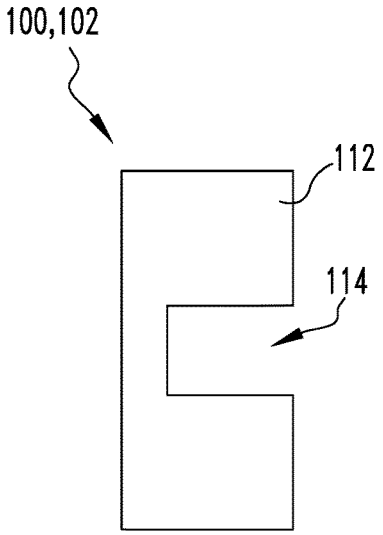
FIG. 6A is a front elevation view of a spacer member in accordance with an example embodiment of the disclosed concept.
Figure 6B:
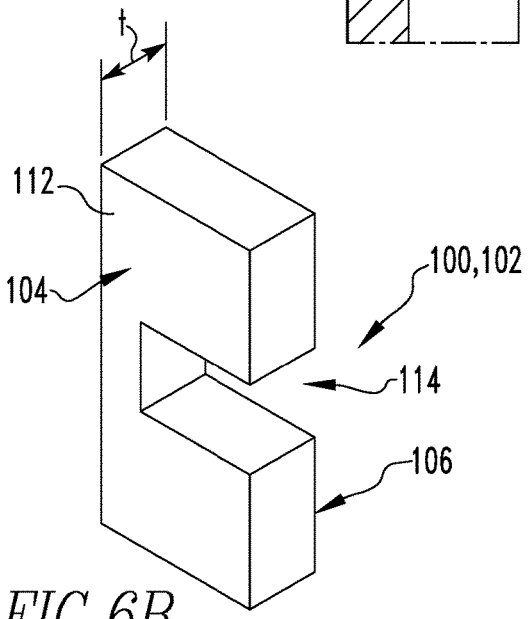
FIG. 6B is a perspective view of the spacer member of FIG. 6A.

As shown in FIGS. 4 and 5, the domer assembly 38 further includes first and second spacer members 100 and 102. In the example shown in FIGS. 4 and 5, each of the first and second spacer members 100, 102 are of the same shape/construction. Referring to FIGS. 6A and 6B, each spacer member 100, 102 is a rigid member (e.g., alloy steel or other suitable material) having a first face 104 and a second face 106 opposite the first face 104. The first and second faces 104 and 106 are spaced a first thickness t from each other. As shown in the sectional view of FIG. 5, when the domer assembly 38 is assembled, the first face 104 of each spacer member 100, 102 is engaged with the subframe 36/60, and the second face 106 is engaged directly or indirectly with a face 108 of the domer door 54 at or about the first portion 84 (or the second portion 86) of the domer door 54. Conversely, the second face 106 of each spacer member 100, 102 may be engaged with the subframe 36/60, and the first face 104 engaged directly or indirectly with the face 108 of the domer door 54 at or about the first portion 84 (or the second portion 86) of the domer door 54. In the example embodiment illustrated in FIG. 5, the domer door 54 includes a pair of protrusions 110, each pair disposed near a respective end 80, 82 of the domer door so as to engage the adjacent spacer member 100, 102 when the domer assembly 38 is assembled. Such protrusions 110 may be formed integrally with the domer door 54, coupled thereto via any suitable arrangement, or may not be present without varying from the scope of the disclosed concept. When present, such protrusions 110 provide a means for setting the final alignment of the domer door 54 by precisely grinding one or more of the protrusions as-needed to achieve the desired alignment.

While each of the spacer members 100 and 102 in the example of FIGS. 4, 5, 6A and 6B are shown generally as a rectangular member 112 having a notch 114 to accommodate one of swing bolts 50 or 52 therein, it is to be appreciated that spacers of other shapes may be employed without varying from the scope of the disclosed concept. When each threaded nut 70 is tightened on the respective threaded portion 58 of each of the first and second swing bolts 50 and 52, the domer door 54 is secured at a predetermined positioning or distance D (FIG. 5) relative to the subframe 36, and thus the frame 19 of the can forming machine 10, dependent on the thickness t of the spacer members 100, 102 employed. It is to be appreciated that by selectively changing the positioning of the domer door 54 with respect to the subframe 36/frame 19 (i.e., the distance D), and thus with respect to other components of the can forming machine 10 (e.g., the die assembly 16), by employing spacers of different predetermined lengths, a single domer door 54 and domer die 40 may be employed with different stroke lengths for forming can bodies of different heights.

In the example embodiment illustrated in FIGS. 2-5, the domer arrangement 38 further includes a hinge arrangement 120 pivotably coupling the first end 80 of the domer door 54 to the subframe 36, and more particularly to the first support arm 60. The hinge arrangement 120 includes an upper hinge pin 122 and a lower hinge pin 124 axially aligned along a common axis 126, and spaced from the upper hinge pin 122. In such embodiment, the first end 80 of the domer door 54 includes an upper cylindrical recess 128 extending downward from a top surface (not numbered) of the domer door 54 and a lower cylindrical recess 130 extending upward from a bottom surface (not numbered) of the domer door 54 that axially aligned with the upper cylindrical recess 128. A lower portion 132 of the upper hinge pin 122 is positioned (e.g., pressed) within the upper cylindrical recess 128 and an upper portion 134 of the upper hinge pin 122 is positioned (e.g., so as to be able to rotate/slide) within an upper aperture 136 of the first support arm 60/subframe 36. An upper portion 138 of the lower hinge pin 124 is positioned (e.g., pressed) within the lower cylindrical recess 130 and a lower portion 140 of the lower hinge pin 124 is positioned (e.g., so as to be able to rotate/slide) within a lower aperture 142 (FIG. 5) of the first support arm 60/subframe 36 that is aligned with the upper aperture 136 of the first support arm 60/subframe 36. In the example embodiment illustrated in FIGS. 3-5, each of the upper and lower apertures 136 and 142 are in the form of elongated slots in which the hinge pins 122 and 124 can slide/rotate as discussed further below.

Figure 3:
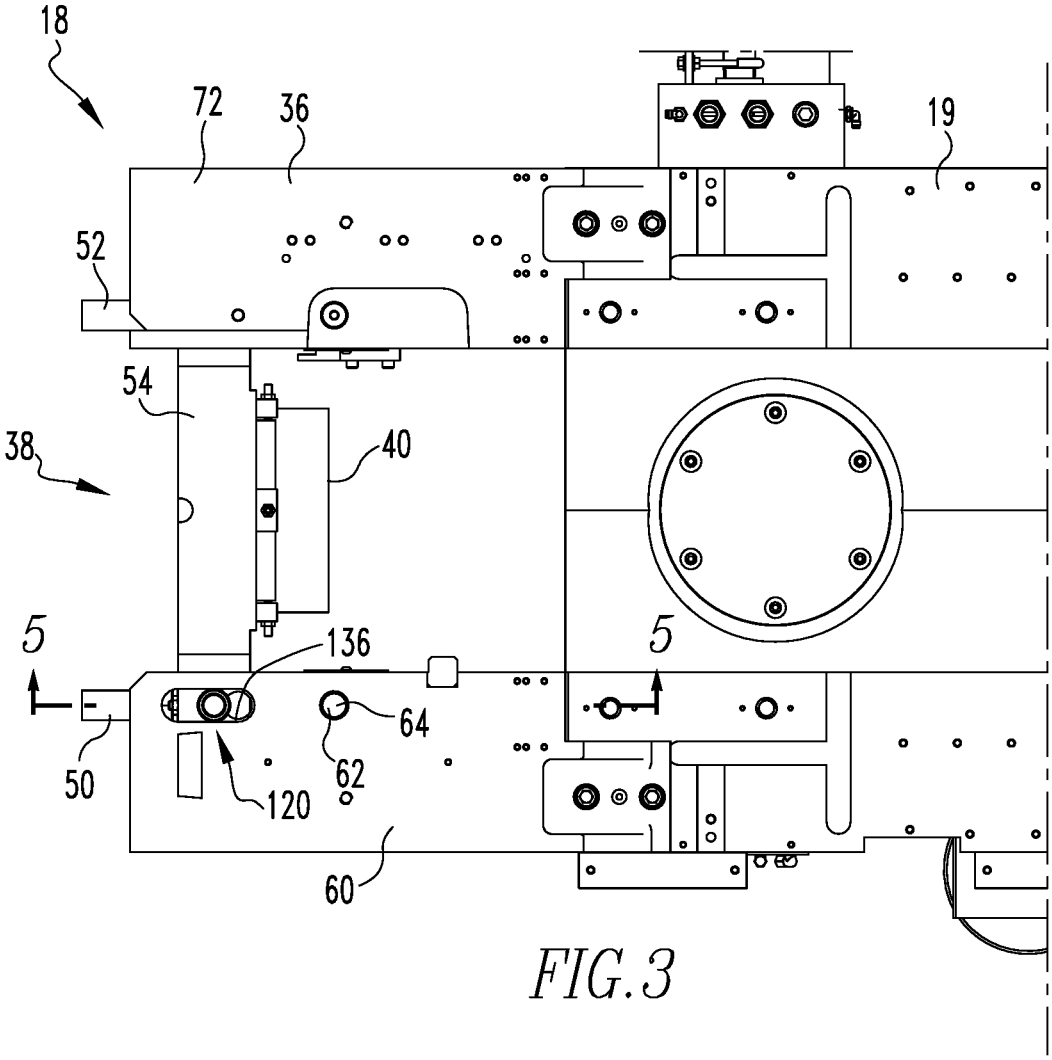
FIG. 3 is a partially schematic top view of the portion of the can forming machine of FIG. 2 shown with a domer die (shown schematically) positioned thereon.
Figure 7:
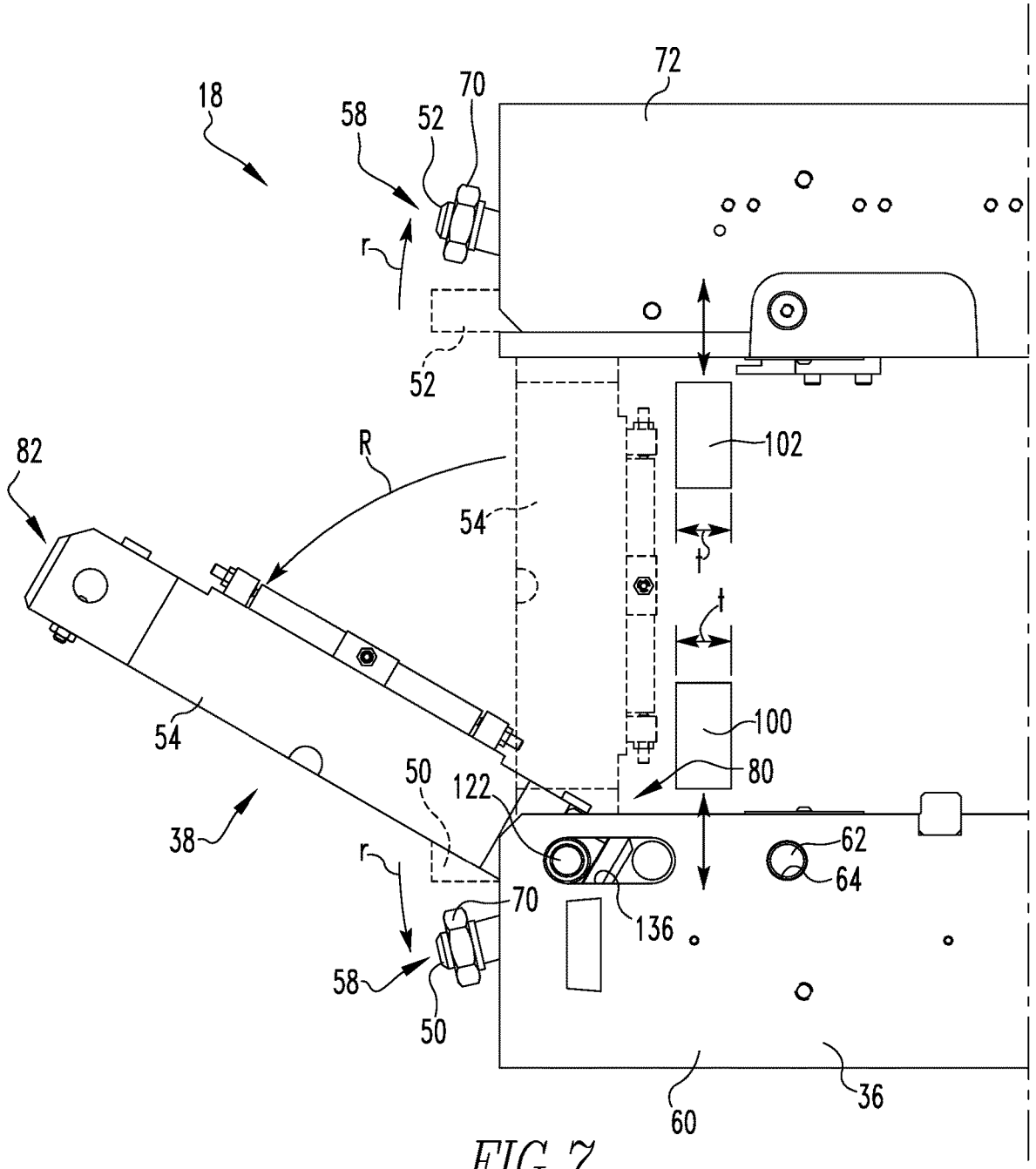
FIG. 7 is a detail view of a portion of the top view of FIG. 3 (without the domer die) shown with the domer door shown in an intermediate position from that of FIG. 3 and a further positioning in which the door is partially swung away from the can forming machine.

Having thus described the components of a domer arrangement 38 in accordance with an example embodiment of the disclosed concept and the arrangement thereof, a brief discussion of the operation/functionality thereof will now be provided in conjunction with FIGS. 3 and 7. Starting with FIG. 3, the domer arrangement 38 is shown in an assembled/locked in positioning wherein the domer door 54 and the domer die 40 coupled to the domer door 54 are fixedly positioned to the subframe 36 of the domer arrangement as well as the frame 19 of the can bodymaker 10 ready for can body making operations to be performed. As shown in FIG. 5, at such time a face of the domer door 54 is positioned a known distance D from the frame 19 of the bodymaker 10. It is to be appreciated that while in this example a face of the domer door 54 and the frame 19 of the bodymaker 10 are used as reference points, any other suitable desired reference points may be employed without varying from the scope of the disclosed concept. When a change in height of the can bodies being formed by bodymaker 10 is desired, operation of the bodymaker 10 is stopped, and each of the threaded nuts 70 are backed off the first and second swing bolts 50 and 52 toward the second ends 58 thereof. Once the nuts 70 have been sufficiently loosened 9 (e.g., such as shown in FIG. 7), the swing bolts 50 and 52 are rotated outward (such as shown by the arrows r in FIG. 7). With the swing bolts 50 and 52 rotated out of the way the first end 80 of the domer door 54 is able to slide outward a predetermined amount, away from the frame 19 of the bodymaker 10 (i.e., by the upper and lower hinge pins 122 and 124 sliding in the upper and lower apertures 136 and 142 until the outermost ends thereof). At the same time, the domer door 54 is able to be rotated about the hinge pins 122 and 124 (such as shown by the arrow R in FIG. 7) in a manner such that the second end 82 of the domer door 54 may be swung away from the second support arm 72 of the subframe 36. In example embodiments of the disclosed concept the domer door 54 may be swung outward 90° or more. When the domer door 54 is disposed in such "open" positioning, a domer die 40 (FIG. 3) can be readily uninstalled from, or installed onto, the domer door 54 if desired. Additionally, the spacer members 100 and 102 can be removed for replacement by other spacer members of a different desired thickness t suitable for the desired height of the can body to be produced by the bodymaker 10.

Moving from such "open" positioning such as shown in FIG. 7 to the "closed" operating positioning such as shown in FIG. 3 is accomplished by reversing the previous steps. More particularly, the domer door 54 is swung closed and slid toward the frame 19 of the bodymaker 10 until it abuts the desired spacer members 100, 102 corresponding to the height of the can bodies to be produced. Each of the swing bolts 50 and 52 are rotated inward (i.e., in the opposite direction of arrows r in FIG. 7) and each of the threaded nuts 70 are tightened and torqued down on each of the swing bolts 50 and 52 to the appropriate torque specifications.

From the foregoing, it is thus to be appreciated that embodiments of the disclosed concept provide for a bodymaker which can produce can bodies of different heights simply by switching spacer members in a domer assembly thereof. It is also to be appreciated, that embodiments of the disclosed concept may be readily retrofit to bodymakers not originally including such an adjustable domer assembly such as described herein.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of disclosed concept which is to be given the full breadth of the claims appended and any and all equivalents thereof.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

What is claimed is:

1. A domer arrangement for use in supporting a domer die in a can bodymaker, the domer arrangement comprising:

a subframe structured to be coupled to a frame of the can forming machine;

a domer assembly comprising:

a domer door comprising a first end and a second end opposite the first end, the domer door being structured to have the domer die coupled thereto between the first end and the second end;

a first spacer member having a first face and a second face opposite and spaced a first thickness from the first face, the first face of the first spacer member engaged with the subframe and the second face of the first spacer member engaged with the domer door at or about the first end of the domer door;

a second spacer member having a first face and a second face opposite and spaced a second thickness from the first face, the first face of the second spacer member engaged with the domer door at or about the second end of the domer door and the second face engaged with the subframe; and a fastening arrangement rigidly coupling the domer door to the subframe such that the domer door is secured at a predetermined positioning relative to the subframe dependent on the thickness of each of the first and second spacer members; and a hinge arrangement, wherein the domer door is pivotably and slidably coupled to the subframe at or about the first end thereof via the hinge arrangement, and wherein:

the hinge arrangement comprises an upper hinge pin and a lower hinge pin axially aligned with, and spaced from the upper hinge pin;

the first end of the domer door comprises an upper cylindrical recess extending downward from a top surface of the domer door and a lower cylindrical recess extending upward from a bottom surface of the domer door axially aligned with the upper cylindrical recess;

a lower portion of the upper hinge pin is positioned within the upper cylindrical recess of the first end of the domer door and an upper portion of the upper hinge pin is positioned within an elongated slot defined in the subframe; and an upper portion of the lower hinge pin is positioned within the lower cylindrical recess of the first end of the domer door and a lower portion of the lower hinge pin is positioned within another elongated slot defined in the subframe.

2. The domer arrangement of claim 1, wherein:

the subframe comprises a first support arm and a second support arm;

the first support arm includes a first end structured to be coupled to the frame of the can forming machine and a second end selectively coupled to the first end of the domer door via a portion of the fastening arrangement; and the second support arm includes a first end structured to be coupled to the frame of the can forming machine and a second end selectively coupled to the second end of the domer door via another portion of the fastening arrangement.

3. The domer arrangement of claim 1, further comprising the domer die coupled to the domer door.

4. The domer arrangement of claim 1, further comprising:

a third spacer member having a first face and a second face opposite the first face, the first face of the third spacer member being structured to be engaged with the domer door at or about the first end of the domer door and the second face of the third spacer member being structured to be engaged with the subframe; and a fourth spacer member having a first face and a second face opposite the first face, the first face of the fourth spacer member being structured to be engaged with the domer door at or about the second end of the domer door and the second face of the fourth spacer member being structured to be engaged with the subframe, wherein the first face and the second face of the third spacer member are spaced a third distance different than the first distance, wherein the first face and the second face of the fourth spacer member are spaced a fourth distance different than the second distance, wherein the third spacer member is structured to be positioned in place of the first spacer member, and wherein the fourth spacer member is structured to be positioned in place of the second spacer member.

5. A domer arrangement for use in supporting a domer die in a can bodymaker, the domer arrangement comprising:

a subframe structured to be coupled to a frame of the can forming machine, and a domer assembly comprising:

a domer door comprising a first end and a second end opposite the first end, the domer door being structured to have the domer die coupled thereto between the first end and the second end;

a first spacer member having a first face and a second face opposite and spaced a first thickness from the first face, the first face of the first spacer member engaged with the subframe and the second face of the first spacer member engaged with the domer door at or about the first end of the domer door;

a second spacer member having a first face and a second face opposite and spaced a second thickness from the first face, the first face of the second spacer member engaged with the domer door at or about the second end of the domer door and the second face engaged with the subframe; and a fastening arrangement rigidly coupling the domer door to the subframe such that the domer door is secured at a predetermined positioning relative to the subframe dependent on the thickness of each of the first and second spacer members, wherein the fastening arrangement comprises:

a first swing bolt having a first end and a second end opposite the first end, the first end being pivotably coupled to the subframe and the second end having a threaded portion extending therefrom toward the first end;

a second swing bolt having a first end and a second end opposite the first end, the first end being pivotably coupled to the subframe and the second end having a threaded portion extending therefrom toward the first end;

a first threaded nut threadingly engaged with the threaded portion of the first swing bolt; and a second threaded nut threadingly engaged with the threaded portion of the second swing bolt, and wherein when the first threaded nut and the second threaded nut are each tightened on the respective threaded portions of the first and second swing bolts, the domer door is secured at the predetermined positioning dependent on the thickness of each of the first and second spacer members.

6. The domer arrangement of claim 5, further comprising a first pin coupled to the subframe and a second pin coupled to the subframe, wherein:

the first swing bolt comprises an aperture defined therein at the first end of the first swing bolt;

the second swing bolt comprises an aperture defined therein at the first end of the second swing bolt;

the first end of the first swing bolt is pivotably coupled to the subframe via engagement between the first pin and the aperture defined at the first end of the first swing bolt; and the first end of the second swing bolt is pivotably coupled to the subframe via engagement between the second pin and the aperture defined at the first end of the second swing bolt.

7. The domer arrangement of claim 6, wherein:

the domer door comprises a first notched portion defined in the domer door extending inward from the first end of the domer door;

the domer door comprises a second notched portion defined in the domer door extending inward from the second end of the domer door;

the first swing bolt is positioned in the first notched portion; and the second swing bolt is positioned in the second notched portion.

8. The domer arrangement of claim 5, further comprising the domer die coupled to the domer door.

9. The domer arrangement of claim 5, further comprising:

a third spacer member having a first face and a second face opposite the first face, the first face of the third spacer member being structured to be engaged with the domer door at or about the first end of the domer door and the second face of the third spacer member being structured to be engaged with the subframe; and a fourth spacer member having a first face and a second face opposite the first face, the first face of the fourth spacer member being structured to be engaged with the domer door at or about the second end of the domer door and the second face of the fourth spacer member being structured to be engaged with the subframe, wherein the first face and the second face of the third spacer member are spaced a third distance different than the first distance, wherein the first face and the second face of the fourth spacer member are spaced a fourth distance different than the second distance, wherein the third spacer member is structured to be positioned in place of the first spacer member, and wherein the fourth spacer member is structured to be positioned in place of the second spacer member.

10. A can forming machine comprising:

a frame;

an operating mechanism coupled to the frame and structured to reciprocally move a ram body between a first retracted position and a second extended position;

a ram body comprising an elongated body with a longitudinal axis and a distal end;

a punch disposed at the distal end of the ram body;

a die assembly coupled to the frame and having at least one die with an opening therein and a longitudinal axis;

the punch positioned to move generally horizontally through the die opening with said ram body longitudinal axis and said die assembly longitudinal axes being substantially aligned; and a domer arrangement comprising:

a subframe structured to be coupled to a frame of the can forming machine;

a domer assembly comprising:

a domer door comprising a first end and a second end opposite the first end, the domer door being structured to have the domer die coupled thereto between the first end and the second end;

a first spacer member having a first face and a second face opposite and spaced a first thickness from the first face, the first face of the first spacer member engaged with the subframe and the second face of the first spacer member engaged with the domer door at or about the first end of the domer door;

a second spacer member having a first face and a second face opposite and spaced a second thickness from the first face, the first face of the second spacer member engaged with the domer door at or about the second end of the domer door and the second face engaged with the subframe; and a fastening arrangement rigidly coupling the domer door to the subframe such that the domer door is secured at a predetermined positioning relative to the subframe dependent on the thickness of each of the first and second spacer members; and a hinge arrangement, wherein the domer door is pivotably and slidably coupled to the subframe at or about the first end thereof via the hinge arrangement, wherein:

the hinge arrangement comprises an upper hinge pin and a lower hinge pin axially aligned with, and spaced from the upper hinge pin;

the first end of the domer door comprises an upper cylindrical recess extending downward from a top surface of the domer door and a lower cylindrical recess extending upward from a bottom surface of the domer door axially aligned with the upper cylindrical recess;

a lower portion of the upper hinge pin is positioned within the upper cylindrical recess of the first end of the domer door and an upper portion of the upper hinge pin is positioned within an elongated slot defined in the subframe; and an upper portion of the lower hinge pin is positioned within the lower cylindrical recess of the first end of the domer door and a lower portion of the lower hinge pin is positioned within another elongated slot defined in the subframe.

11. The can forming machine of claim 10, wherein:

the subframe comprises a first support arm and a second support arm;

the first support arm includes a first end structured to be coupled to the frame of the can forming machine and a second end selectively coupled to the first end of the domer door via a portion of the fastening arrangement; and the second support arm includes a first end structured to be coupled to the frame of the can forming machine and a second end selectively coupled to the second end of the domer door via another portion of the fastening arrangement.

12. The can forming machine of claim 10, further comprising the domer die coupled to the domer door.

13. The can forming machine of claim 10, further comprising:

a third spacer member having a first face and a second face opposite the first face, the first face of the third spacer member being structured to be engaged with the domer door at or about the first end of the domer door and the second face of the third spacer member being structured to be engaged with the subframe; and a fourth spacer member having a first face and a second face opposite the first face, the first face of the fourth spacer member being structured to be engaged with the domer door at or about the second end of the domer door and the second face of the fourth spacer member being structured to be engaged with the subframe, wherein the first face and the second face of the third spacer member are spaced a third distance different than the first distance, wherein the first face and the second face of the fourth spacer member are spaced a fourth distance different than the second distance, wherein the third spacer member is structured to be positioned in place of the first spacer member, and wherein the fourth spacer member is structured to be positioned in place of the second spacer member.

14. A can forming machine comprising:

a frame;

an operating mechanism coupled to the frame and structured to reciprocally move a ram body between a first retracted position and a second extended position;

a ram body comprising an elongated body with a longitudinal axis and a distal end;

a punch disposed at the distal end of the ram body;

a die assembly coupled to the frame and having at least one die with an opening therein and a longitudinal axis;

the punch positioned to move generally horizontally through the die opening with said ram body longitudinal axis and said die assembly longitudinal axes being substantially aligned;

a domer arrangement comprising:

a subframe structured to be coupled to a frame of the can forming machine; and a domer assembly comprising:

a domer door comprising a first end and a second end opposite the first end, the domer door being structured to have the domer die coupled thereto between the first end and the second end;

a first spacer member having a first face and a second face opposite and spaced a first thickness from the first face, the first face of the first spacer member engaged with the subframe and the second face of the first spacer member engaged with the domer door at or about the first end of the domer door;

a second spacer member having a first face and a second face opposite and spaced a second thickness from the first face, the first face of the second spacer member engaged with the domer door at or about the second end of the domer door and the second face engaged with the subframe; and a fastening arrangement rigidly coupling the domer door to the subframe such that the domer door is secured at a predetermined positioning relative to the subframe dependent on the thickness of each of the first and second spacer members; and a hinge arrangement, wherein the domer door is pivotably and slidably coupled to the subframe at or about the first end thereof via the hinge arrangement, wherein the fastening arrangement comprises:

a first swing bolt having a first end and a second end opposite the first end, the first end being pivotably coupled to the subframe and the second end having a threaded portion extending therefrom toward the first end;

a second swing bolt having a first end and a second end opposite the first end, the first end being pivotably coupled to the subframe and the second end having a threaded portion extending therefrom toward the first end;

a first threaded nut threadingly engaged with the threaded portion of the first swing bolt; and a second threaded nut threadingly engaged with the threaded portion of the second swing bolt, and wherein when the first threaded nut and the second threaded nut are each tightened on the respective threaded portions of the first and second swing bolts, the domer door is secured at the predetermined positioning dependent on the thickness of each of the first and second spacer members.

15. The can forming machine of claim 14, further comprising a first pin coupled to the subframe and a second pin coupled to the subframe, wherein:

the first swing bolt comprises an aperture defined therein at the first end of the first swing bolt;

the second swing bolt comprises an aperture defined therein at the first end of the second swing bolt;

the first end of the first swing bolt is pivotably coupled to the subframe via engagement between the first pin and the aperture defined at the first end of the first swing bolt; and the first end of the second swing bolt is pivotably coupled to the subframe via engagement between the second pin and the aperture defined at the first end of the second swing bolt.

16. The can forming machine of claim 15, wherein:

the domer door comprises a first notched portion defined in the domer door extending inward from the first end of the domer door;

the domer door comprises a second notched portion defined in the domer door extending inward from the second end of the domer door;

the first swing bolt is positioned in the first notched portion; and the second swing bolt is positioned in the second notched portion.

17. The can forming machine of claim 14, further comprising the domer die coupled to the domer door.

18. The can forming machine of claim 14, further comprising:

a third spacer member having a first face and a second face opposite the first face, the first face of the third spacer member being structured to be engaged with the domer door at or about the first end of the domer door and the second face of the third spacer member being structured to be engaged with the subframe; and a fourth spacer member having a first face and a second face opposite the first face, the first face of the fourth spacer member being structured to be engaged with the domer door at or about the second end of the domer door and the second face of the fourth spacer member being structured to be engaged with the subframe, wherein the first face and the second face of the third spacer member are spaced a third distance different than the first distance, wherein the first face and the second face of the fourth spacer member are spaced a fourth distance different than the second distance, wherein the third spacer member is structured to be positioned in place of the first spacer member, and wherein the fourth spacer member is structured to be positioned in place of the second spacer member.

* * * * *